United States Patent [19]

Bissell

[11] 4,030,703

[45] June 21, 1977

[54] SIMPLE MACHINE

[76] Inventor: Henry M. Bissell, 6321 Riggs Place, Los Angeles, Calif. 90045

[22] Filed: Nov. 22, 1974

[21] Appl. No.: 526,256

[52] U.S. Cl. ..... 254/135 R; 226/114; 74/136

[51] Int. Cl.[2] ..... B66D 1/00

[58] Field of Search ..... 254/120, 135 R, 127, 254/73, 76, 105, 143, 191, 139; 74/136, 137, 138, 140, 141; 226/113, 114

[56] References Cited

UNITED STATES PATENTS

| | | | |
|---|---|---|---|
| 434,701 | 8/1890 | Conway | 254/127 |
| 893,678 | 7/1908 | Van Wie | 254/135 R |
| 1,231,014 | 6/1917 | Goodwill | 254/135 R |
| 1,754,132 | 4/1930 | Van Bekkum | 254/135 R |
| 2,585,101 | 2/1952 | Faure | 254/135 R |
| 3,410,525 | 11/1968 | Tanson | 254/105 |

*Primary Examiner*—L. J. Paperner
*Assistant Examiner*—Kenneth Noland
*Attorney, Agent, or Firm*—Henry M. Bissell

[57] ABSTRACT

A device for multiplying the force applied to deflect a tensile member attached to a weight or load. The device may be used in place of a block and tackle and provides substantially greater mechanical advantage without the additional length of line needed by a block and tackle to string over the additional pulleys employed. Various embodiments employ one or two unidirectional motion members and a lever pivotably mounted to the frame for applying the deflecting force. Additional mechanical advantage is achieved by selectively locating the pivot mounting of the lever.

25 Claims, 9 Drawing Figures

SIMPLE MACHINE

BACKGROUND OF THE INVENTION

1. Field of the Invention

This invention principally relates to the field of lifting and pulling devices and, more particularly, to such devices which develop force multiplication through the manual operation of a lever member.

2. Description of the Prior Art

Various pulley and rope systems are known as simple machines for developing a mechanical advantage, i.e. the ratio of the force exerted by the machine to the force exerted on the machine, which is greater than one. A simple block and tackle is a common example of such a machine. One set of pulleys is fixed in position and another set of pulleys is attached to the weight to be lifted. Each movable pulley is suspended by two "falls" of rope. By increasing the number of pulleys and falls of rope, the mechanical advantage is increased according to the formula: $W = nP$, where $W$ is the load, $P$ is the force applied, and $n$ is the number of falls of rope that support the moving block. Another way of putting it is that the block and tackle develops the mechanical advantage of two for each movable pulley. One disadvantage of such a machine is the requirement for the additional rope needed to develop the loops about the extra pulley pairs. Furthermore, the mechanical advantage is limited by the number of pulleys and falls of rope in a given block and tackle system in accordance with the above-stated formula. If additional mechanical advantage is needed, additional operative pulleys must be incorporated into the system.

Other simple machines have incorporated levers and variable grip mechanisms for developing the desired mechanical advantage in lifting, hoisting ahd hauling various loads. Such machines are limited in the mechanical advantage achieved to the well-known relationship of the relative distances from fulcrum to load and fulcrum to point of force application.

Related prior art of which applicant is aware include the following U.S. Pat. Nos.: 224,746 of Trump; 430,282 of Gauttard; 434,701 of Conway; 520,426 of Hammerly; 535,884 of Bellamy; and 2,107,500 of Price et al. Except for the Price et al., all of the patents listed were issued before 1900. It is therefore apparent that very little development of an innovative nature has occurred in this century in the field to which the present invention relates. This suggests the possibility that the present invention constitutes an entirely new type of simple machine, despite its apparent simplicity and the fact that its outstanding mechanical advantage is developed through the adaptation of a principle usually taught in high school physics courses.

SUMMARY OF THE INVENTION

A practical application of this principle sometimes occurs with disastrous results on washdays when a slight deflecting load is applied to an overly-taut clothesline and produces more tension in the line than it or its terminal fastenings can bear. In accordance with the present invention, if the line is secured at one end and free to move near its other end on the opposite side of the point of application of the deflecting force, a considerable mechanical advantage can be realized so that a substantial load can be pulled in this fashion. In one particular arrangement in accordance with the present invention, the deflecting force is applied by means of a pivotably-mounted lever and a unidirectional motion member is employed as the anchor for the line during application of the deflecting force. After the load has been advanced toward the machine, the lever is withdrawn from the point of deflection and the slack in the line is taken up by pulling the line through the unidirectional motion member for the next cycle of application of the deflection force and corresponding advance of the load.

Where the line is aligned vertically, application of the deflecting force in a generally horizontal direction (normal to the line) is utilized with substantial mechanical advantage to lift a load of considerable weight. This is accomplished in other arrangements in accordance with the present invention which utilize a frame mounting a pair of unidirectional motion members which alternately provide a point of fixed support for the load.

In one such arrangement in accordance with the present invention, the frame includes a support structure for the lifting machine and the load itself. In such a case, the structure must be of substantial strength, since the frame members are arranged as compression load members to support the load being lifted, in addition to some of the members comprising cantilevered portions of the frame.

In another particular arrangement in accordance with the present invention, the load is supported entirely by members in tension rather than compression so that the rigid support members of the frame may be dispensed with. In this arrangement, the frame comprises simply a pair of unidirectional motion members, the upper one being adapted to be hung from a support structure and the other being suspended from the upper member by means of one or more ropes, cables or the like. A simple rod or tube, preferably adjustable as to length, may be extended between the two unidirectional motion members to maintain the spacing between these two members when the deflecting force is applied to the flexible line supporting the load so that the lower unidirectional motion member is not lifted with the flexible line which extends through it. In still another arrangement in accordance with the present invention, a deflectible rod is used for supporting the load instead of a line or rope. This rod is selected from a material such as fiberglass, nylon or some other suitable plastic so that it is deflectible by the pivotable lever member, but still has sufficient rigidity to keep the two unidirectional motion members spaced apart during operation of the device.

The lever member may have a plurality of pivot attachment points and bearing member mountings located at strategic intervals along its extent so that it can be adjusted to balance the various loads which may be applied to the machine.

In yet another arrangement in accordance with the present invention, the frame is provided with various points for pivotably mounting the lever member in order to develop still further mechanical advantage. Thus, in an extreme instance, the lever member may be pivotably mounted so that its arcuate path of travel of the deflecting bearing member may be very nearly tangent to the line supporting the load. In such a case, as the lever member rotates through some angle which includes the point of application of the deflection force to the load support line, the component of force normal to the line varies as the cosine of the angle made by the lever member with the normal. This is a minimal change in the deflecting force for a maximum movement of the deflection lever, thus developing further mechanical advantage in a device which already provides extreme mechanical advantage for small deflection angles.

DESCRIPTION OF THE PREFERRED EMBODIMENTS

Figure 1:
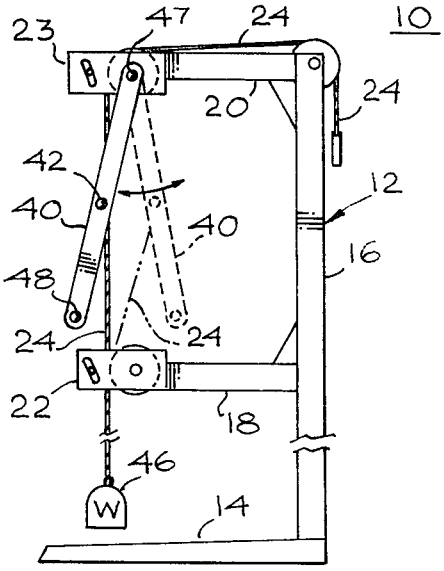
FIG. 1 is an elevational view of one particular arrangement in accordance with the present invention.

Referring to FIG. 1, there is shown a simple machine 10 in accordance with the present invention, comprising a frame 12 having a base 14, an upright 16, and a pair of horizontal cantilevered members 18 and 20. Each of the members 18, 20 supports a corresponding unidirectional motion member 22 or 23. The members 22, 23 are constructed so as to permit the forward (upward) movement of a line 24, but to block the return movement of the line 24.

Figure 2:
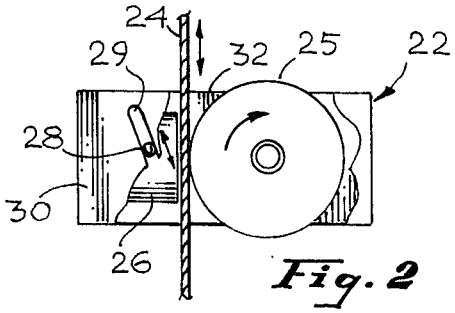
FIG. 2 is an enlarged view, partially broken away, showing details of a portion of the arrangement of FIG. 1.

Details of the construction of one particular type of unidirectional motion member such as 22 are shown in FIG. 2 as comprising a pulley 25, a slidable block 26, and a guide pin 28 mounted within a slot 29 of a front face plate 30 (shown partially broken away). A corresponding slot and guide pin may be arranged in a rear face plate 32 to maintain alignment of the block 26 in a fashion which permits the block to be moved upwardly and away from contact with the pulley 25 as the line advances upwardly. However, when the line 24 tends to return in the downward direction, gravity and the friction with the line 24 serve to pull the block 26 downward to engage tightly against the line 24 and pulley 25 so that further movement of the line 24 in the return or downward direction is prevented. Other structural arrangements for unidirectional motion members are known, and such may be employed in arrangements such as 10 in accordance with the present invention, if desired.

Returning to FIG. 1, there is also shown a deflecting member in the form of a lever 40 having a bearing element 42 positioned to engage the line 24 approximately midway between the two unidirectional motion members 22, 23. A weight 44 is also provided at the upper end of the line 24, and a load 46 attached to the lower end of the line 24 is shown being lifted by the machine 10 as the line 24 is advanced to the member 22.

In operation of the device 10 of FIG. 1, the lever 40, pivotably mounted to the frame 16 at the point 47, is rotated by means of manual force applied to a handle 48 so that the bearing member 42 bears against the line 24 and deflects it to a position indicated by the broken line outline. To assume this position, the line 24 must be pulled up or advanced through the lower unidirectional motion member 22, since movement of the line 24 in a downward direction through the upper unidirectional motion member 23 is prevented by means of the mechanism thereof. Thus, the weight 46 is raised by an extent corresponding to the amount of line 24 pulled through the lower unidirectional motion member 22 as the line is deflected by the lever 40. When the deflecting force exerted by the lever 40 through the bearing member 42 against the line 24 is removed, as when the lever 40 is returned to the lefthand, solid-line position indicated in the drawing, the line 24 is prevented from returning downward through the lower unidirectional motion member 22 so that the weight is retained at the level to which it had been raised. The line 24 would thus be slack, except for the influence of the weight 44 which is sufficient to pick up the slack by advancing the line 24 through the upper unidirectional motion member 23 until the line 24 is restored to the taut position. The machine is then ready for another cycle of operation in which the lever 40 is rotated in a counter-clockwise direction around the pivot point 47 in order to raise the weight 46 by another increment of distance. Successive back-and-forth operations of the lever 40 serve to advance the weight 46 to the desired elevation underneath the lower unidirectional motion member 22.

Figure 3:
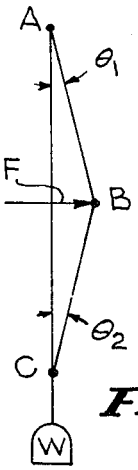
FIG. 3 is a schematic diagram presented for the purpose of illustrating the mechanical advantage realized by arrangements in accordance with the present invention.

While the operation of the arrangement of FIG. 1 may be easily understood from the above description thereof, a better appreciation of the substantial mechanical advantage afforded by this machine may be realized through a consideration of the diagram of FIG. 3. The triangle ABC of FIG. 3 corresponds to the positions of the line 24 of FIG. 1 in both the straight, undeflected position and in the deflected position, due to the application of the deflecting force F. The relationship of the weight W (equal to the tension forces along the sides of the triangle ABC) and the deflecting force F may be expressed by the following:

$$W = \frac{F}{2\sin\theta} \quad (1)$$

and $$\frac{W}{F} = \frac{1}{2\sin\theta} \quad (2)$$

where $\theta$ equals the deflection angle, assuming $\theta_1$ equal $\theta_2$. It may be readily noted that a tremendous advantage (equal to W/F) results for small values of $\theta$. In fact, as $\theta$ approaches zero, the mechanical advantage approaches infinity. Furthermore, the mechanical advantage may be said to be automatically variable in accordance with the load being lifted; that is, for extremely heavy loads, the deflecting force is applied through very small angles ($\theta$) for maximum mechanical advantage. However, for lighter loads, the same deflecting force F will deflect the line 24 through a greater angle of $\theta$ for increased advance of the line 24 and weight 46 for each cycle of application of the same deflecting force F. This may be better appreciated by reference to the following table:

Table I

| $\theta°$ | $\sin\theta$ | $\frac{1}{\sin\theta}$ | M.A. |
|---|---|---|---|
| 2 | .03490 | 28.65 | 57.31 |
| 4 | .06976 | 14.33 | 28.67 |
| 6 | .10453 | 9.57 | 19.13 |
| 8 | .13917 | 7.19 | 14.37 |
| 10 | .17365 | 5.76 | 11.52 |
| 12 | .20791 | 4.81 | 9.62 |
| 14 | .24192 | 4.13 | 8.27 |
| 16 | .27564 | 3.63 | 7.26 |
| 18 | .30902 | 3.24 | 6.47 |
| 20 | .34202 | 2.92 | 5.85 |

It may thus be seen that for deflection angles less than 10°, the mechanical advantage (M.A.) is in excess of 10. Further mechanical advantage is developed by virtue of the leverage action of the lever 40 and the relative distances from the pivot point 47 to the bearing member 42 and the handle 48. Still further factors of mechanical advantage may be introduced by virtue of other structural arrangements described hereinafter in connection with succeeding figures.

Figure 4:
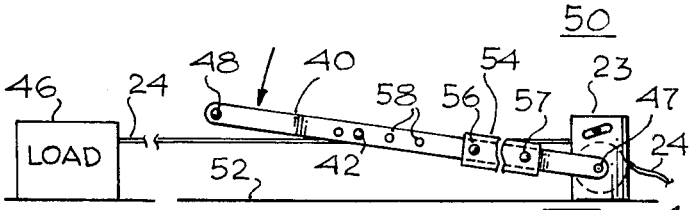
FIG. 4 is a schematic view of a simplified arrangement in accordance with the present invention.

It will be appreciated that the figures in the table listed above are based upon an assumption that the deflection angles $\theta_1$ and $\theta_2$ of the diagram of FIG. 3 are equal. Where these two angles are unequal, as when the bearing member 42 is not centered along the deflected segment of line 24, the figures will be different; but a substantial mechanical advantage will still be achieved within reasonable limits of the disparity between the angles $\theta_1$ and $\theta_2$. It will also be appreciated from the figures of Table I that the mechanical advantage is automatically variable, depending upon the extent to which the operator is able to deflect a line 24. The same deflecting force F will deflect the line 24 through a greater angle for a light load than it will for a heavy load. As the force is applied to deflect the line 24 through all angles less than the maximum deflection angle attained, the mechanical advantage begins at a high figure and decreases until the line 24 reaches a limit of deflection for the given deflection force. This is different from, and presents a particular advantage over, most other simple machines in which the mechanical advantage, if adjustable, is still constant for a given setting or adjustment, so that the operator cannot automatically select the mechanical advantage in accordance with what is comfortable for him, but must set up the machine and try it to see if his selected mechanical advantage is suitable. This usually requires several cut-and-try adjustments, until the desired setting is reached. By contrast, the operator of the simple machine of the present invention merely applies whatever deflecting force he is capable of, and the mechanical advantage varies accordingly.

Where the nature of the load being moved is such that it is unnecessary to restrain the line 24 from returning to its previous position prior to advancement of the weight 46 as the lever 40 is pulled back to begin another cycle—as where the load is being pulled along a load bearing surface or the inertia of the load is such as to hold it in an advanced position temporarily, the lower unidirectional control member 22 may be dispensed with. Such an arrangement in accordance with the invention is shown in FIG. 4, in which like elements are referred to by corresponding reference numerals. In FIG. 4, a system 50 is shown comprising a unidirectional motion member 23 of the type already described. It will be understood that the member 23 is anchored to the ground or base 52 upon which the load 46 rests. The lever 40 is shown pivotably mounted to the member 23 at the point 47 for counterclockwise rotation, to deflect the line 24 downward and advance the load 46. Return of the lever 40 permits slack in the line 24 which may be withdrawn manually or by other means to the right of the member 23. During this time, the load 46, being frictionally engaged on the surface 52, stays in position, Thereafter, the lever 40 may be again moved downwardly to deflect the line 24 and advance the load 46 still further. It will be appreciated that the lever 40 could just as well be mounted with the bearing member 42 on the underside of the line 24, so that the lever 40 would be rotated upwardly (clockwise) to deflect the line 24.

As already indicated, it is desirable to have the bearing member 42 positioned approximately midway of the deflectible portion of the line 24. In the arrangement of FIG. 1, this calls for it being located midway between the undirectional motion members 22, 23. In the arrangement of FIG. 4, this means that it should be located midway between the position of the load 46 and the unidirectional motion member 23. However, in the arrangement 50 of FIG. 4, advancement of the load 46 results in the bearing member 42 no longer being centered between the end points of the deflectible portion of the line 24. Various adjustable means may be employed to provide for recentering of the member 42. One such arrangement is afforded by means of the extender 54, which is used with a two-piece lever 40 joined thereto by pins 56 and 57. Another arrangement for varying the position of the bearing member 42 relative to the pivot point 47 is afforded by the differently-spaced mounting holes 58 which permit the bearing member 42 to be easily relocated at desired positions along the extent of the lever 40, being moved from one mounting hole 58 to another closer to the pivot point 47 as the load 46 is advanced.

Figure 5:
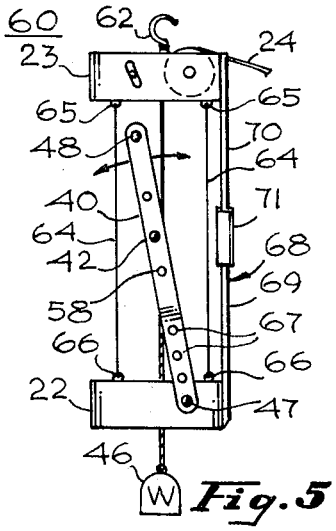
FIG. 5 is a schematic elevational view of another arrangement in accordance with the present invention.

Another embodiment 60, as shown in FIG. 5, is designed so that all load bearing members are supported by cables in tension in order that the need for a rigid structure such as is shown in FIG. 1 is eliminated. The embodiment 60 of FIG. 5 incorporates a pair of unidirectional motion members 22, 23 as before. However, the upper member 23 is provided with a hook 62 for hanging the machine from some overhead support member. The lower unidirectional motion member 22 is suspended from the upper unidirectional motion member 23 by means of a pair of cables 64 secured between upper and lower eyes 65, 66. The lever 40 is shown pivoted about a pivot point 47 located on the lower unidirectional control member 22. It is mounted in this manner in order to provide automatic counterbalancing of the lateral forces applied to the structure, namely the deflection force directed from left to right by the bearing member 42 against the line 24 and the counterbalancing force applied from right to left against the lower unidirectional control member 22 at the pivot point 47. It may be desirable to adjust the position of the bearing member 42 relative to the pivot point 47, depending upon the weight of the load 46 and other factors. For this reason, various pivot mounting holes 67 are provided along the rod 40 for selective mounting of the pivot point 47, and a plurality of holes 58 are provided for adjustably positioning the bearing member 42 along the lever 40. The only compression member which may be needed in the embodiment 60 of FIG. 5 is the member 68 extending between the two unidirectional motion members 22, 23 and affixed respectively thereto at opposite ends. The member 68 may comprise a relatively lightweight tubing, since it is needed only to insure that the lower unidirectional motion member 22 is not pulled upwardly with the line 24 as the line 24 is deflected by the bearing member 42 during clockwise rotation of the lever 40. In this arrangement, member 68 should not encounter any force from the load 46 itself or the lifting mechanism. It is preferably arranged to be adjustable in length, as by telescoping between the two opposed sections 69 and 70, centrally joined by a locking member 71, particularly in the event that the cables 64 between the eyes 65, 66 are adjustable in length.

Figure 6:
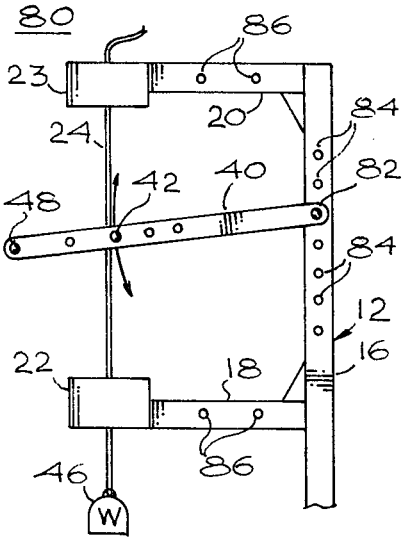
FIG. 6 is a schematic elevational view of still another arrangement in accordance with the present invention.

Still another arrangement 80 is shown in FIG. 6 for the purpose of illustrating a feature of the invention by which a still further mechanical advantage may be achieved. This arrangement is similar to that shown in FIG. 1, except that the lever 40 is arranged for mounting at a pivot point 82 which may be selectively located at various points along the frame 12. A plurality of mounting holes 84 are positioned along the vertical frame member 16 and other mounting holes 86 are shown along the cantilevered members 18 and 20. With the lever 40 mounted for rotation about the pivot point 82 as shown in FIG. 6, the lever 40 must be rotated through a substantial angle in order to produce a slight deflection of the line 24. This additional mechanical advantage is afforded by virtue of the fact that the horizontal component of distance from the pivot point 82 to the bearing member 42 varies as the cosine of the angle between the lever 40 and a line through the pivot point 82 which is normal to the undeflected line 24. Again, the lever 40 is provided with a plurality of holes for adjustably determining the effective lengths of the lever 40 and the relative distances from the pivot point to the bearing member 42 and to the handle 48.

Figure 7:
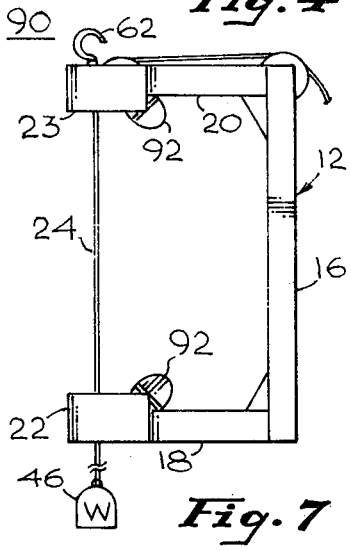
FIG. 7 is a schematic elevational view of yet another arrangement in accordance with the present invention.

Still another arrangement in accordance with the invention is depicted in FIG. 7. In this figure, a system 90 is provided which eliminates the use of the deflection member 40 of the other arrangements of the invention, and instead provides a structure which is adapted for the application of a manually-provided deflection force with means for accommodating a reactive force applied to the structure by the operator. The system 90 is shown comprising a frame 12 having a longitudinal rigid member 16 supporting a pair of cantilevered beams 18 and 20 on which respective unidirectional motion members 22 and 23 are mounted. A hook 62 is provided for supporting the upper portion of the structure in either a horizontal or vertical attitude. A deflectible tensile member 24 is shown attached at one end to a weight 46 and strung through the unidirectional motion members 22, 23. In the system 90, the deflecting member 40 per se is dispensed with, since it is intended that the user of the system 90 will manually deflect the tensile member 24. To assist in this purpose, means are provided for accommodating a reactive force applied by the user against the framework 12. In the example shown, these means comprise a pair of foot rests 92 mounted respectively adjacent the unidirectional motion members 22 and 23. In the use of such an arrangement, it is contemplated that the support 62 will be mounted so as to permit the weight 46 to be dragged along a more or less horizontal base so that the user may seat himself adjacent the longitudinal member 16 and place his feet in the foot rests 92. He may then pull repeatedly upon the tensile member 24 in order to deflect it in successive cycles, similar to the action of a person rowing a boat. As he releases the tensile member 24 in the region between the two unidirectional motion members 22, 23, the user will grip the free end of the line 24 and pull the slack out through the unidirectional motion member 23.

Alternatively, in the event that the system 90 is mounted by means of the hook 62 in a vertical attitude, the user may bear against the longitudinal member 16 with his shoulder, for example, while repeatedly pulling against the deflectible tensile member 24 to advance the weight 46 in the upward direction. If desired, for particular applications of the system 90 in which the user maintains his feet against the foot rests 92 in a fashion to maintain the spacing between the unidirectional motion members 22, 23, the longitudinal member 16 may be dispensed with. Such an arrangement would be similar to the arrangement 60 of FIG. 5, without the strut member 68 and the deflection member 40. The cables 64 would, however, be used to support the unidirectional motion members 22, 23 with the predetermined spacing therebetween. Application of the counteracting force of the user against the unidirectional motion members 22, 23 in this fashion would obviate the need for providing a counterbalancing force specifically developed by virtue of the deflection member 40 and its pivotable mounting on the lower unidirectional motion member 22 as in FIG. 5.

Figure 8:
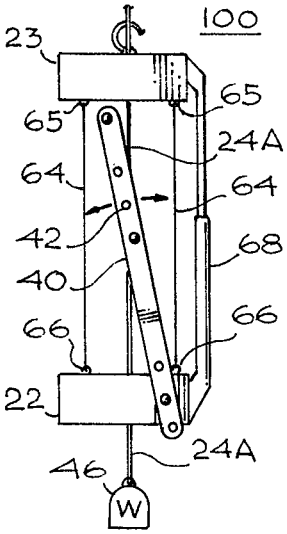
FIG. 8 is a schematic elevational view of a further arrangement in accordance with the present invention.

It will be understood that it is not necessary for the line 24 to be non-resiliently yieldable as in the case of an ordinary rope. All that is required is that it be deflectible. Such an arrangement is shown in FIG. 8, wherein the system 100 is similar to the system 60 of FIG. 5 except for the deflectible member 24A. Wherein in FIG. 5 the deflectible member 24 is shown as a flexible cable or rope, the member 24A of FIG. 8 is a rod or tube which, while deflectible, has sufficient resilience and rigidity to be self-feeding out of the upper unidirectional motion member 23 when the deflecting force is removed during the cycling of the machine. The member 24A may be made of fiberglass, nylon fiber, formed plastic, or other materials having the requisite tensile strength with resilience.

Figure 9:
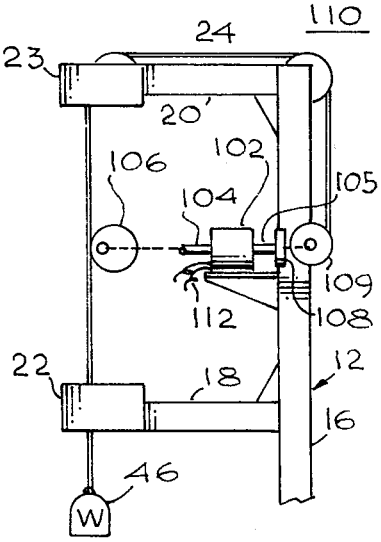
FIG. 9 is a schematic elevational view of a power-driven arrangement in accordance with the present invention.

A power-driven system 110 in accordance with the present invention is shown in FIG. 9 wherein a framework 12 having associated load support and unidirectional motion members 22, 23 similar to the arrangement of FIG. 1 (but without the pivotably-mounted deflection member 40) is provided with a motor 102 having an output shaft 104 on which is mounted on eccentric cam 106. The cam 106 rotates eccentrically on the shaft 104 and, in so doing, cyclically deflects the line 24 between the members 22, 23. As the line 24 is deflected by the cam 106, a portion is advanced through the lower unidirectional motion member 22. As the cam 106 rotates past the point of deflection of the line 24, slack develops in the line 24 which is advanced through the upper unidirectional motion member 23 under the pull exerted by the cable drum 109 coupled to a second motor output shaft 105 via a slip clutch 108. Suitable wires 112 are provided for connection to power mains.

Although there have been described hereinabove various specific arrangements of a simple machine in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered within the scope of the invention as defined in the appended claims.

What is claimed is:

1. A mechanism for pulling a load comprising:

at least one load support member;

means for readily securing the load support member in a selected position;

a unidirectional motion member coupled to the load support member for engaging a deflectible tensile member attached to the load, which load is to be connected adjacent a free end of said tensile member; and a pivoted deflection member for bearing against the tensile member between the unidirectional motion member and the load and transversely deflecting the tensile member to pull the load relative to the support member by successive increments as the slack in the tensile member is taken up through the unidirectional motion member.

2. A mechanism in accordance with claim 1 further including a deflectible tensile member extending through the unidirectional motion member for attachment to a load to be pulled, the tensile member when so attached extending in a position relative to the deflection member such as to be deflectible thereby.

3. A mechanism in accordance with claim 1 further including means for withdrawing the slack portion of the tensile member through the unidirectional motion member when the deflection member is not deflecting the tensile member.

4. A mechanism in accordance with claim 3 wherein the withdrawing means comprises a counter-weight attached to a free end of the tensile member.

5. A mechanism in accordance with claim 1 further including a second load support member having an additional unidirectional motion member engaging the deflectible tensile member at a position nearer the load than is the first-mentioned unidirectional motion member and on the opposite side of the portion of the tensile member contacted by the deflection member from the first-mentioned unidirectional motion member; and means for supporting the second load support member and additional unidirectional motion member in said position.

6. A mechanism in accordance with claim 5 wherein the supporting means comprises at least one tensile support member attached between the two load support members.

7. A mechanism in accordance with claim 1 wherein the deflection member is pivotably mounted to said load support member.

8. A mechanism in accordance with claim 6 wherein the deflection member is pivotably mounted on the second load support member and extends toward the first-mentioned load support member in an attitude such that the force of deflecting the tensile member serves to apply a counterdirectional force to the second support member so as to deflect the tensile member relative to the second support member.

9. A mechanism in accordance with claim 8 wherein the deflection member includes a pivotably-mounted lever and a bearing element mounted thereon for engaging the tensile member at a point substantially midway between the unidirectional motion members.

10. A mechanism in accordance with claim 9 wherein the lever includes a plurality of mounting points for the pivotable mounting of the deflection member, and further includes a plurality of mounting points for the bearing element for selectively determining the lever action forces applied to the tensile member and to the second load support member.

11. A mechanism in accordance with claim 6 further including a strut member extending between the two load support members and affixed respectively thereto.

12. A mechanism in accordance with claim 11 wherein the strut member includes adjustable means for selectively varying the length of said strut between the two load support members.

13. A mechanism in accordance with claim 5 wherein the supporting means comprises a frame structure adapted to supportably mount both of the load support means at a predetermined distance apart from each other.

14. A mechanism in accordance with claim 13 further including means for selectively positioning the pivot point of the deflection member relative to said frame structure in order to develop a selected mechanical advantage of the force applied to deflect the tensile member with respect to the force applied to the deflection member.

15. A mechanism in accordance with claim 13 further including means for varying the pivotable mounting point of the deflection member relative to the frame structure in order to vary the angle at which the deflection member contacts the tensile member during deflection thereof.

16. A mechanism in accordance with claim 1 wherein the unidirectional motion member comprises a rotatable pulley for guiding the tensile member through the unidirectional motor member, a cable brake member mounted to bear against the tensile member and the pulley for attempted movement of the tensile member in a reverse direction through the unidirectional motion member, and cable brake member mounting means for moving the cable brake member to release the tensile member and pulley for forward motion of the tensile member through the unidirectional motion member.

17. A mechanism in accordance with claim 2 wherein the deflectible member is a flexible cable.

18. A mechanism in accordance with claim 2 wherein the deflectible member is a rope.

19. A mechanism in accordance with claim 2 wherein the deflectible member is a resiliently flexible rod.

20. A mechanism for pulling a load comprising:

a pair of load support members mounted on a readily transportable frame positioning the load support members a predetermined distance apart;

each load support member including a corresponding unidirectional motion member; and a deflectible tensile member extending through the unidirectional motion members for attachment to the load at one end, the tensile member being deflectable transversely at a point between the two load support members to develop an increased tension in the portion of the tensile member between the upper support member and the load, so as to pull the load by successive increments as slack is taken up through the upper support member;

the unidirectional motion members being adapted to permit motion of the tensile member therethrough in the forward direction and to block motion of the tensile member therethrough in the reverse direction.

21. A mechanism in accordance with claim 20 further including means coupled to the frame for applying a reactive force during manual deflection of the tensile member between the two load support members by an operator.

22. A mechanism in accordance with claim 20 further including first power-driven means for cyclically deflecting the tensile member to advance the tensile member and attached load relative to the unidirectional motion members.

23. A mechanism in accordance with claim 22 wherein the power-driven means comprise an eccentric cam mounted on a rotatable shaft adjacent the tensile member approximately midway between the two unidirectional motion members, and including motor means coupled to the shaft for driving said eccentric cam.

24. A mechanism in accordance with claim 22 further including second power-driven means for withdrawing the portion of the tensile member advanced by the operation of the first power-driven means and storing said portion.

25. A mechanism in accordance with claim 24 wherein the second power-driven means comprises a cable drum and slip clutch mounted on a rotatable shaft, and including motor means coupled to the shaft for driving said clutch and drum.

* * * * *